US007469425B2

(12) United States Patent
DeStefano

(10) Patent No.: US 7,469,425 B2
(45) Date of Patent: Dec. 30, 2008

(54) DISPOSABLE BIB WITH INTEGRAL PLACEMAT

(75) Inventor: Frank S. DeStefano, Surprise, AZ (US)

(73) Assignee: Sabo Worldwide LLC, Surprise, AZ (US)

( * ) Notice: Subject to any disclaimer, the term of this patent is extended or adjusted under 35 U.S.C. 154(b) by 0 days.

(21) Appl. No.: 11/897,188

(22) Filed: Aug. 29, 2007

(65) Prior Publication Data

US 2008/0172768 A1 Jul. 24, 2008

Related U.S. Application Data

(60) Provisional application No. 60/882,000, filed on Jan. 23, 2007.

(51) Int. Cl.
*A41B 13/10* (2006.01)

(52) U.S. Cl. ..... 2/49.3; 2/49.1; 2/49.2

(58) Field of Classification Search ..... 2/48, 2/49.1–49.5, 50, 51, 52, 46, 75, 80; D2/860–864
See application file for complete search history.

(56) References Cited

U.S. PATENT DOCUMENTS

| | | | | | |
|---|---|---|---|---|---|
| 83,120 | A | | 10/1868 | Mott | |
| 284,671 | A | * | 9/1883 | Reed | 2/49.5 |
| 590,991 | A | | 10/1897 | Lenhart | |
| 1,108,557 | A | | 8/1914 | Dudley | |
| 2,105,029 | A | | 1/1938 | Doty | |
| 2,224,746 | A | * | 12/1940 | Brown Richstein | 2/48 |
| 2,457,725 | A | | 12/1948 | Rhowmine | |
| 2,532,932 | A | | 12/1950 | Neiswander | |
| 2,594,053 | A | * | 4/1952 | McKewen | 2/49.5 |
| 2,643,384 | A | | 6/1953 | Thompson | |
| 2,738,511 | A | | 3/1956 | Brady | |
| 2,762,053 | A | | 9/1956 | Lipscomb | |
| 2,767,403 | A | | 10/1956 | Givens | |
| 2,905,943 | A | * | 9/1959 | Carlisle et al. | 2/49.5 |
| 3,995,321 | A | | 12/1976 | Johnson | |
| 4,068,313 | A | * | 1/1978 | Goldman | 2/49.1 |
| 4,114,199 | A | | 9/1978 | Malan | |
| 4,301,544 | A | | 11/1981 | Burton | |
| 4,441,212 | A | | 4/1984 | Ahr et al. | |
| 4,523,333 | A | | 6/1985 | Spangler | |
| 5,056,159 | A | | 10/1991 | Zemke, Jr. | |
| D338,319 | S | | 8/1993 | Bickel | |
| 5,915,530 | A | | 6/1999 | Hager | |
| 5,956,763 | A | | 9/1999 | Blackshear | |
| 5,960,471 | A | * | 10/1999 | Burton | 2/48 |

(Continued)

*Primary Examiner*—Amy B Vanatta
(74) *Attorney, Agent, or Firm*—Gerald E. Hespos; Anthony J. Casella; Michael J. Porco

(57) ABSTRACT

A bib for adult and infant use having a multi-ply construction with both a permeable and impermeable ply. The bib includes a collar section which has an aperture securable about the neck of the wearer. The dimensions of the bib are selected so that an apron portion of the bib can be detachably secured to a table surface and a pouch is formed in the area above the wearer's lap when the wearer is seated in a normal position with respect to the table surface. The opposite side edges of the bib in the pouch area are formed with barriers to prevent food from spilling from the bib to minimize clean-up and soilage. The apron portion secured to a table surface provides a sanitary placemat.

20 Claims, 4 Drawing Sheets

U.S. PATENT DOCUMENTS

| | | | | |
|---|---|---|---|---|
| 6,081,923 | A | 7/2000 | Marks | |
| 6,128,781 | A | 10/2000 | Spindler | |
| 6,237,150 | B1 | 5/2001 | Lucas | |
| D448,143 | S | 9/2001 | Shealey | |
| 6,374,411 | B1 | 4/2002 | Duhn | |
| D473,364 | S | 4/2003 | Conte | |
| 6,581,210 | B2 | 6/2003 | Kaloustian | |
| D499,530 | S | 12/2004 | Mintz et al. | |
| 7,103,916 | B1 * | 9/2006 | Goodew et al. | 2/49.1 |
| 7,237,271 | B1 * | 7/2007 | McLandrich | 2/49.3 |
| 2001/0014980 | A1 | 8/2001 | Patterson et al. | |
| 2004/0232749 | A1 | 11/2004 | Mesalic et al. | |
| 2005/0120457 | A1 | 6/2005 | Mesalic | |

* cited by examiner

DISPOSABLE BIB WITH INTEGRAL PLACEMAT

PRIORITY

This application claims priority to an application entitled "DISPOSABLE BIB WITH INTEGRAL PLACEMAT" filed in the United States Patent and Trademark Office on Jan. 23, 2007 and assigned Ser. No. 60/882,000, the contents of which are hereby incorporated by reference.

BACKGROUND OF THE INVENTION

1. Field of the Invention

The present invention relates to bibs and more particularly bibs usable by infants, toddlers, the elderly and others when eating to prevent food spillage from soiling clothes and preventing food from falling to the floor or adjacent surfaces.

2. Background of the Invention

Dining bibs are commonly used both by infants and adults. Parents and attendants of children and infants often attach a bib to the child when the child is eating to prevent spillage and soiling. Many restaurants, particularly specialty restaurants such as seafood restaurants, will provide large bibs for patrons to prevent or minimize spillage and soiling of clothing.

Nursing homes and hospitals which care for the elderly and other patients commonly utilize bibs to prevent soiling clothes and to reduce spillage so that clean-up after meals is minimized. The use of bibs is also a sanitary precaution minimizing exposure to germs as infants and toddlers are often disposed to retrieving food items from a table or tray and placing these items in their mouths. The use of a clean bib surface on which the food falls results in providing germ protection so that food morsels which are subsequently consumed are less likely to be contaminated.

There are a wide variety of types of bibs that can be found in the prior art. Generally both adult and infant bibs have an apron-like body which has an opening or some sort of attachment which can be secured about the neck of the user. Various materials are commonly used. Bibs that are reusable may be cloth or plastic. Disposable bibs are also available in the prior art and generally these are fabricated from plastic material which often are packaged in folded condition and are unfolded or separated at the time of use.

For example, U.S. Publication 2001/0014980 discloses a disposable paper bib for use in a rolled, dispensing manner. Each bib has a neck ring perforated at its uppermost edge.

U.S. Pat. No. 4,523,333 discloses a disposable bib of a flexible sheet material having a tape-tab fastener. At the time of use, the parting line is opened and the tape-tab fastener is peeled so the bib may be placed around the wearer's neck and secured in place.

U.S. Pat. No. 6,237,150 shows a disposable bib for catching foods and liquids particularly while feeding an infant or toddler. The disposable bib includes a panel having a top layer, middle layer and a bottom layer. The top layer comprises a relatively porous material, the middle layer is a relatively absorbent material and the bottom layer is a relatively non-porous material. The disposable bib further includes a pocket member for catching debris which protrudes from a lower portion of the bib away from the chest of a user. While the bib protects the chest of the user, the pocket member only protrudes a relative small distance outward and will not provide adequate protection to the user's lap.

Other bibs can be found in the prior art which are fabricated from a fabric material such as a polyester, and are termed "crumb catcher bibs" which have a pocket extending across the bottom of the bib to catch food that is spilled on to the surface of the bib.

U.S. Publication 2005/0120457 shows a placemat and protective covering for infants which includes a main placemat area which may be placed on a table to provide a clean eating surface. The covering may be attached to the side arms of a highchair or child seat so that most of the surfaces of the highchair or other child seat and table surrounding the baby are covered by the placemat. The covering further includes a separate bib portion that may be coupled to the placemat. This combination requires assembly and may be easily separated by a restless infant or child, resulting in any dropped debris or liquid to land on the user's lap or floor.

BRIEF SUMMARY OF THE INVENTION

Briefly, the present invention provides a bib which may be either reusable or disposable and which may be utilized both by adults and infants and toddlers. The bib has a body of sufficient length to normally extend from the neck of the user to an adjacent table or eating surface thereby covering the chest and lap of a user. The body is generally narrow in the area of the collar, which allows the user's arms free movement while wearing the bib, and extends outwardly to an apron section. The collar defines an opening or aperture and one or more slits extend radially from the aperture. At least one slit extends to the edge of the collar so that the aperture may be placed about the neck of the user. At the time of use, a fastener, which may be loop and hook material, an adhesive tab, a length of material to be tied, etc., secures the collar about the wearer's neck.

The body of the bib is fabricated from any suitable material, but is preferably a multi-ply construction having one ply of an impermeable, non-absorbent material such as a vinyl or other plastic, e.g., polypropylene. The upper ply, which is preferably a soft, absorbent material such as a cotton, textile or even some polymers. In some instances when added absorption is required, an intermediate ply or layer may be included. The bottom surface of the body of the apron section of the bib is provided with one or more adhesive strips with peelable covers which are removed at the time of use so that the body portion of the bib may be secured to a surface such as a table top or tray to form a germ-free placemat for food and the like. The bib is provided with barriers adjacent along the sides of the bib, e.g., an intermediate or pouch portion, which will deflect spilled food items to prevent them from falling from the bib onto the floor or adjacent surfaces. The barriers may be in the form of pleats or gathers formed in the bib by sewing or by creasing at the time of fabrication.

The overall length of the bib is sufficient so that the bib will normally extend from the neck of the wearer and be secured to an adjacent dining or picnic table top or surface to serve as a placemat. The body portion intermediate the section attached to the table, preferably drapes or hangs so that it extends into the lap area of the individual forming a pouch in which food items which fall on the bib or are deflected by the side barriers will collect in this area to facilitate quick and easy clean up at the conclusion of the meal.

Thus, there is a need for an inexpensive, disposable bib for both adult and infant use which will fully protect the wearer and which will minimize spillage onto adjacent surfaces.

According to one aspect of the present invention, a bib for protecting a chest and lap area of a user is provided, the bib including a generally rectangular planar body including a top surface and a bottom surface, the body including an upper collar section, an intermediate section and a lower apron section; the upper collar section includes a aperture configured to be disposed about a neck of the user for supporting the body on the user; the lower apron section includes a placemat section configured for attaching to a surface disposed adjacent the user; wherein the intermediate portion defines a pouch between the user and the surface, the intermediate portion includes a barrier disposed on each side of the body configured for preventing debris from leaving the pouch.

In another aspect, a bib for protecting a chest and lap area of a user includes a generally rectangular planar body including a top surface and a bottom surface, the body including an upper section, an intermediate section and a lower section; first means for attaching the upper section of the body about a neck of the user for supporting the body on the user; second means for attaching the lower section to a surface disposed adjacent the user, wherein the lower section forms a placemat on the adjacent surface; and barrier means disposed on each side of the intermediate section configured for preventing debris from leaving the intermediate section positioned between the user and the surface.

BRIEF DESCRIPTION OF THE DRAWINGS

The above and other advantages and objects of the present invention will become more readily apparent to those having ordinary skill in the art from the following description, claims and drawings in which:

DETAILED DESCRIPTION

Figure 1:
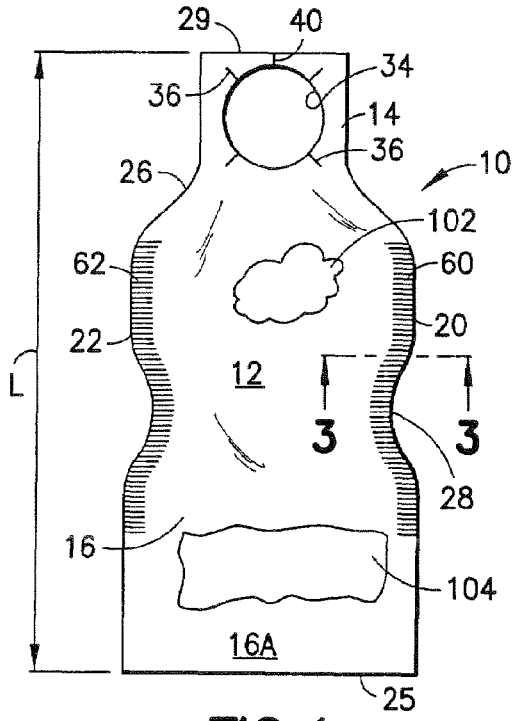
FIG. 1 is a top or plan view of a bib according to the present invention.
Figure 2:
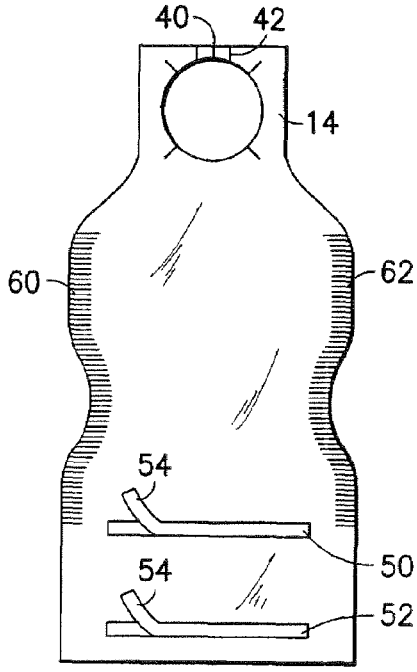
FIG. 2 is a bottom plan view of a preferred embodiment of the bib according to the present invention.

Turning now to the drawings, a bib of the present invention is generally designated by the numeral 10. The bib 10 has a body 12 which has a collar section 14 and an apron section 16. The body 12 has opposite side edges 20 and 22 which may taper inwardly at their upper ends 26 to the collar section. The sides may also taper inwardly at an intermediate location 28. The bottom edge 25 extends transversely between the side edges. The bib may be provided in various sizes such as infant, toddler and adult sizes and it is understood that the basic construction and features are the same. The overall dimensions are selected in accordance with the particular user. However, when the overall length L is chosen so that the bib, when worn, will extend down the chest area of the user into the lap of the user and then is directed upwardly so that the lower placemat end is positionable on a surface such as a table. This creates a pouch area 30, as seen in FIGS. 3 to 6, between the wearer and the table or tray surface T which will collect dropped food items. The length L also facilitates use in other settings such as on an infant in a car seat or by an adult eating while a driving or as a passenger in a vehicle.

The upper collar area 14 defines an aperture 34 which is shown as being generally circular having a diameter sized to comfortably receive the neck of an intended user. One or more radial slits 36 extend from the aperture 34 to fit or accommodate individuals having various neck sizes. At least one radially extending slit 40 extends from the upper edge 29 of the collar to the neck aperture 34 so that the neck aperture may be placed around the wearer's neck.

Figure 7:
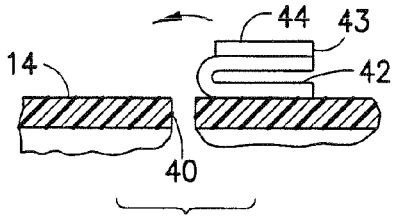
FIG. 7 is a cross-sectional view showing a fastener in the form of an adhesive tab located at the neck opening.
Figure 7A:
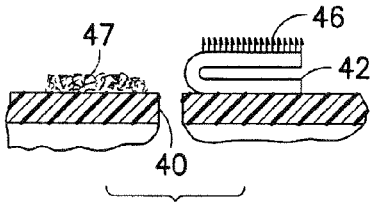
FIG. 7A shows an alternate embodiment form of the fastener.

As seen in FIG. 7, a tab 42 is secured adjacent the slit 40 and has an adhesive 43 and is covered with a peelable covering 44. In use, the bib is placed about the user's neck and the peelable cover 44 is removed to expose the adhesive. The tab 42 can then be extended to abridge the slit so that the bib is secured in place. Alternately, the tab may have a fastener comprising one section 46 of a loop and hook fastener material with the mating section 47 located on the opposite side of the slit 40, as illustrated in FIG. 7A. The tab 42 can be extended across the slit 40 and the loop and hook components releasibly joined.

Figure 7B:
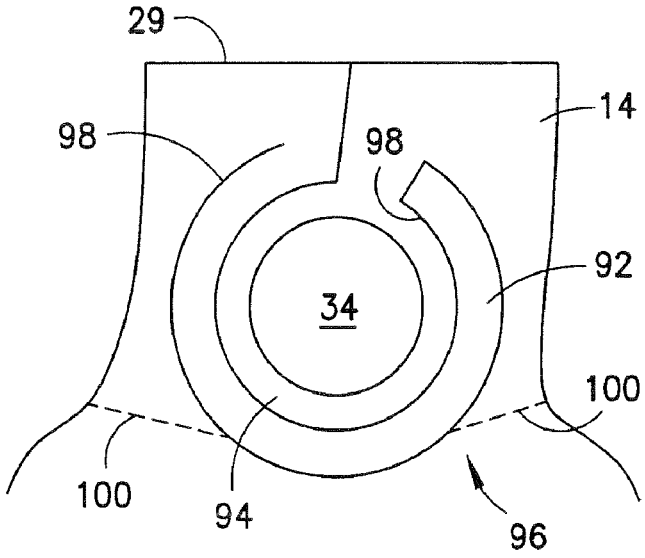
FIGS. 7B and 7C show a further embodiment of fastener.
Figure 7C:
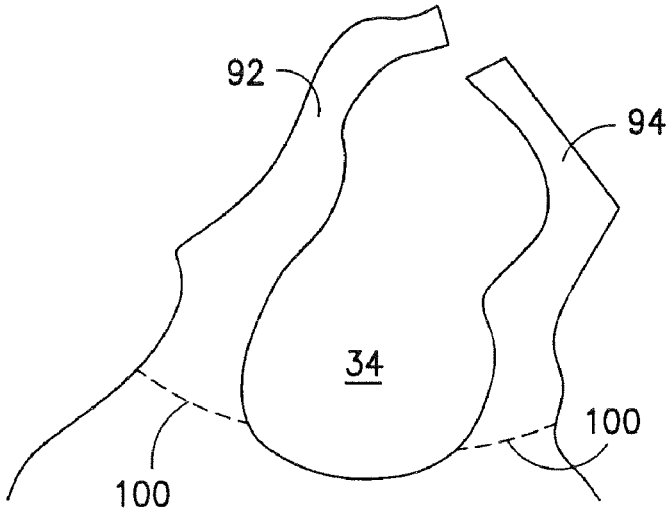

In a further embodiment, a fastening mechanism or device to be used about the user's neck will include at least two lengths of material to be tied approximate to the back of the user's neck. In one embodiment, the at least two lengths of material may be strings coupled to the upper edge 29 of the collar section 14. In another embodiment as shown in FIGS. 7B and 7C, the fastening mechanism 90 will be formed from two lengths 92, 94 of the same material as used to form the body 12. When the aperture 34 is cut in the collar section 14, a plurality of circular cuts 96, 98 will be made. When the material is removed from the aperture 34, the remaining material may be separated upon use to form two lengths of material 92, 94 which may be tied about the user's neck. The two lengths of material 92, 94 will further include perforations 100 so the bib can easily "break-away" if too much tension is applied to the lengths 92, 94. Furthermore, the perforations will allow the bib to easily removed by pulling downward on the bib when the user is finished using the bib in lieu of untying the lengths of material. It is to be appreciated any fastener selected can easily "break away" to avoid injury to the user.

The bib may be fabricated from various materials for reuse or may be made disposable. One preferred material is a multi-ply material having a soft, absorbent upper ply 80 and an impermeable, non-absorbent lower ply 82. Materials of this type are used in various products such as disposable diapers and one material that may be used for the absorbent ply 80 is a non-woven, meltblown laminate. The thickness may vary, but preferably for flexibility and economy of manufacture, a thickness of 1 to 5 mils has been found sufficient for most applications. The lower ply 82 may be a polymer such as vinyl, polyethylene, polypropylene or the like, which will prevent any liquids on the bib from seeping through to the user. In a further embodiment, a middle layer is disposed between top layer 80 and lower layer 82 as a filler layer to increase the absorption properties of the bib.

Figure 4:
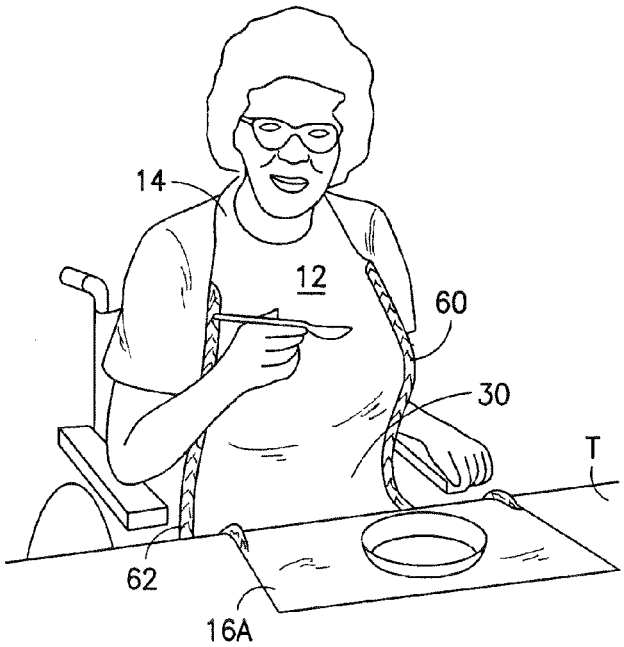
FIG. 4 illustrates the use of an adult version of the bib of the present invention.
Figure 5:
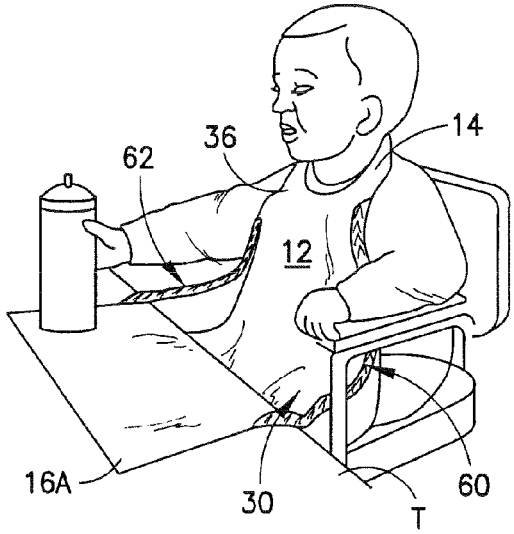
FIG. 5 illustrates the use of the bib of the present invention by an infant or toddler.
Figure 6:
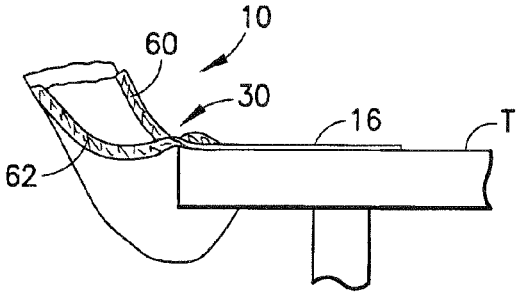
FIG. 6 illustrates the bib of the present invention in a position of use with the lower portion of the bib secured to a surface such as a table top.

The lower end of the apron section 16 defines a placemat section 16A. The lower placemat section 16A of the apron section is intended to be placed on a surface such as a table or tray to provide a sanitary surface. The underside of the bib in the area of the placemat is provided with fastening means. The fastening means are shown as a pair of spaced-apart strips 50, 52 having an adhesive surface. The adhesive is covered by a peelable cover 54 which is removed at the time of use so that the bib may be removably attached to a table or tray surface as seen in FIGS. 4 to 6. In another embodiment, the underside of the lower placemat section 16A may be substantially covered in a low-tack, re-adherable adhesive such as the adhesive disclosed in U.S. Pat. No. 3,691,140, the contents of which are incorporated by reference. In this embodiment, the adhesive would not require a peelable cover reducing manufacturing costs.

Figure 3:
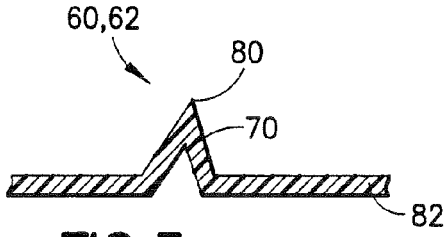
FIG. 3 is a sectional view taken along line 3-3 of FIG. 1 showing a barrier at the side of the bib.
Figure 3A:
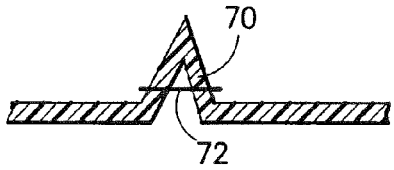
FIG. 3A is a view similar to FIG. 3 showing an alternate form of a barrier.

A significant advantage of the Applicant's bib is the increased length L which allows the bib to extend down the front of the user to the lap of the user and then returned upward to a table top. The apron end is securable to the table top by adhesive strips 50, 52. The pouch 30 in the area of the lap of the user will serve to collect spilled food items, thus preventing spilled food items from falling on the floor for easier clean up and better protection for clothing. To further prevent spilled food items from falling on to the floor, the opposite side edges of the bib are provided with flexible barrier or deflector sections 60, 62. The flexible barrier or deflector sections 60, 62 extend substantially the length of the apron portion of the bib, adjacent side edges 20, 22. The barrier sections extend upwardly from the surface of the bib on the opposite side edges as seen in FIGS. 3 and 3A. The barriers 60, 62 may be formed by a plurality of pleats 70 which are impressed or formed into the material of the bib at the time of fabrication by application of heat and pressure. The pleats are best seen in FIG. 3. By including a flexible barrier or deflector section, the barrier or deflector section will expand and/or contract as dictate by the movement of the user allowing the pouch to also expend and contract. In this manner, as the user moves back and forth the placemat section 16A adhered to the table or surface will remain on the surface and not be pulled away.

Alternately, the barriers 60 and 62 at the opposite side edges of the bib may be formed by affixing a raised bead or strip to the side edges as shown or by gathering the side edges and securing them with stitching 72 as seen in FIG. 3A.

The dimensions of the bib may vary in accordance with the intended use. A child or infant size may typically have overall dimensions of about 36-38" in length and 18-20" in width. An adult size may be approximately 36-40" in overall length and 18-22" overall 20 width.

The top surface of the bib may be suitably decorated with any design, commercial advertisement or logo such as design 102 seen in FIG. 1. In commercial applications for use at restaurants such as specialty seafood restaurants, the restaurant's name and logo can be imprinted on the surface. Bibs intended for use by children may carry suitable graphics such as a cartoon character and/or an amusement device 104, e.g., a game or puzzle, may be applied in the placemat section 16A. The absorbent surface may also allow a child to write or draw on the surface to amuse and occupy the child during mealtime.

In use, the wearer, such as an infant as seen in FIG. 5, is positioned on a seat such as a highchair adjacent to the table top T. The bib 10 is secured about the child's neck by separating the slit extending between the neck aperture and the upper edge of the bib. Once in place, the peelable cover 40 on the adhesive strip 42 is removed and the separated sections are joined or the sections may be joined by loop and hook components. Both types of fasteners are selected to break-away in case of an emergency to prevent injury. The child may be positioned a suitable distance from the table top and the adhesive strips 50, 52 on the bottom of the apron section of the bib are exposed by removing the peelable covers 54. The placemat section 16A can be temporarily attached to the table top forming a pouch 30 between the wearer and the table top. In this position, the barriers or deflectors 60, 62 on the 20, 22 opposite sides of the bib are also raised. If the child drops food, the food will tend to collect in the pouch area 30. Food items which would otherwise tend to fall from the side of the bib will also be deflected inwardly to be collected in the pouch area.

The placemat 16A provides a sanitary protective cover so that food falling in this area, if consumed by the child, will not be in contact with germs that may be present on the surface of the table.

When the child finishes a meal, the collar section 14 can be detached from the neck of the child and folded to retain the collected food items within the bib and the entire bib can be discarded.

The bib in adult sizes may be worn as seen in FIG. 4 again secured to a surface T forming a pouch 30. The barriers 60, 62 will serve to deflect food items onto the bib surface. The bib may be used for geriatric care and by those confined to a wheelchair and for general use to improve sanitation, reduce spillage and reduce clean-up.

In making the bibs, individual bibs are cut into generally rectangular planar sheets from a roll of suitable material. Initially, large rolls of non-woven fabric is first identified by it's characteristics, e.g., hydrophobic fabric absorbs just oils, and therefore would absorb sauces, dressings, etc vs. hydrophilic material which would also absorb water and liquids. In this manner, an 18 inch spread of non-woven material can hold a large quantity of liquids. Next, printing typically occurs at this point on the rolls of fabric. For example, as the roll of fabric is rolled out, a logo 102 may be printed on the top surface of the body 10. Furthermore, an amusement device 104 such as a game or puzzle may be printed on the top surface of the lower apron section. Then, the lower layer, e.g., plastic such as polypropylene, is then installed on the back of the fabric. This steps is typically done by hugh roll cylinders as it's rolled on huge tables, other methods known in the art may be utilized.

Next, the body is fabricated using either stamps, lasers, etc. to make various cuts in the fabric such as the aperture 34 and the neck slits 36 extending from the aperture 34. Then, the barrier 60, 62, e.g., gathers, are installed. Various types of gathers may be selected from elongated, flat, cylinder type, etc. Lastly, the fastening means 50, 52 is installed or applied to the bottom surface of the apron section. The completed bib is then folded and packaged.

The bib according to the present invention can be packaged in any convenient manner such as single or multiple packs. Preferably, the individual bibs would be folded into a compact size and would be unfolded at the time of use. The bibs may be provided in bulk for commercial use. In one embodiment, the bib is packaged as a single unit and provided to a user with a meal such as a prepackaged child's meal at a retail food chain. In another embodiment, a plurality of bibs are packaged in a box structure where a single bib is dispensed as need. In this embodiment, as one bib is dispensed, the next bib will be moved into a position to be easily dispensed next.

It will be obvious to those skilled in the art to make various changes, alterations and modifications to the invention described herein. To the extent such changes, alterations and modifications do not depart from the spirit and scope of the appended claims, they are intended to be encompassed therein.

What is claimed is:

1. A bib for protecting a chest and lap area of a user, the bib comprising:

a generally planar body including a top surface and a bottom surface, the body including collar, an apron and an intermediate section between the collar and the apron;

the collar includes an aperture configured to be disposed about a neck of the user for supporting the body on the user;

the apron includes a placemat section configured for attaching to a surface disposed adjacent the user;

wherein the intermediate section defines a pouch between the collar and the placemat section, the intermediate section includes a flexible barrier disposed on each side of the body configured for preventing debris from leaving the pouch, wherein the flexible barrier extends upwardly from portions of the top surface of the body defining the pouch and is configured to expand and contract as dictated by movement of the user to allow the pouch to expand and contract.

2. The bib of claim 1, wherein at least one radial slit extends from the aperture so that the collar is configured to accommodate a plurality of different neck sizes.

3. The bib of claim 1, wherein one radial slit extends from the aperture to an upper edge of the collar for disposing the collar about the neck of the user, the bib further comprising a fastening device configured for securing the collar.

4. The bib of claim 3, wherein the fastening device is an adhesive tab or a loop and hook fastener.

5. The bib of claim 3, wherein the fastening device comprises two lengths of material formed from the collar section and configured to be tied about the neck of the user.

6. The bib of claim 3, wherein the fastening device is configured to break away.

7. The bib of claim 1, wherein the body comprises an upper absorbent layer and a lower non-absorbent layer.

8. The bib of claim 7, wherein the body further comprises an intermediate absorbent layer disposed between the upper and lower layers.

9. The bib of claim 1, wherein the barrier is formed from a plurality of pleats, a plurality of gathers, a raised bead or a strip.

10. The bib of claim 1, further comprising an amusement device printed on the top surface of the placemat section.

11. The bib of claim 10, wherein the amusement device is a game, puzzle or drawing area.

12. The bib of claim 1, wherein the bottom surface of the body includes at least first and second strips of adhesive disposed on the apron and aligned parallel to an edge of the body farthest from the collar, portions of the apron between the first and second adhesive strips define the placemat section.

13. A bib for protecting a chest and lap area of a user, the bib comprising:

a generally planar body including a top surface and a bottom surface, the body including a collar, an apron section and an intermediate section between the collar and the apron;

the collar includes an aperture configured to be disposed about a neck of the user for supporting the body on the user;

the apron includes a placemat section configured for attaching to a surface disposed adjacent the user, the bottom surface of the body at the apron includes a first adhesive strip parallel to an edge of the body farthest from the collar and a second adhesive strip parallel to the first adhesive strip and positioned between the first adhesive strip and the intermediate section, the placemat section extending between the first and second adhesive strips; and the intermediate section defines a pouch and barrier disposed on each side of the body configured for preventing debris from leaving the pouch, wherein the barrier is flexible and configured to allow the pouch to expand and contract upon movement of the apron while the collar is attached to the user.

14. The bib of claim 13, further comprises an amusement device printed on the top surface of the defined placemat section.

15. The bib of claim 14, wherein the amusement device is a game.

16. The bib of claim 14, wherein the amusement device is a drawing area.

17. The bib of claim 14, wherein the barrier device is formed from a plurality of pleats.

18. The bib of claim 17, further comprising an advertisement printed on the intermediate section.

19. The bib of claim 18, wherein the advertisement is a commercial logo.

20. A bib for protecting chest and lap areas of a user, the bib comprising: a flexible sheet of material having opposite top and bottom surfaces, opposite first and second end edges and opposite first and second side edges extending between the end edges, an aperture being formed through an area of the flexible sheet of material in proximity to the first end edge to define a collar configured to be disposed about a neck of the user for supporting the bib on the user, a placemat section defined adjacent the second end edge, portions of the bottom surface of the sheet of material on the placemat section including a plurality of strips of adhesive aligned substantially parallel to the second end edge for securing the placemat section on a surface in front of the user, a chest protection section extending from the collar towards the placemat and a lap protecting section extending between the chest protecting section and the placemat, the chest and lap protecting sections including first and second barriers disposed respectively adjacent to the first and second side edges of the material and being raised relative to portions of the chest and lap protecting sections between the first and second barriers for containing debris between the first and second barriers, the first and second barriers being flexible and configured to allowed the pouch to expand and contract in response to forces exerted thereon, areas of the first and second side edges extending along at least portions of the lap protecting section converging towards one another, whereby a pouch is formed between the converging areas of the side edges when the bib is worn by a user.

* * * * *